US005671757A

United States Patent [19]

Woodings

[11] Patent Number: 5,671,757

[45] Date of Patent: Sep. 30, 1997

[54] CIGARETTE FILTERS

[75] Inventor: Calvin Roger Woodings, Nuneaton, United Kingdom

[73] Assignee: Courtaulds Fibres (Holdings) Limited, London, England

[21] Appl. No.: 648,088

[22] PCT Filed: Nov. 24, 1994

[86] PCT No.: PCT/GB94/02581

§ 371 Date: May 28, 1996

§ 102(e) Date: May 28, 1996

[87] PCT Pub. No.: WO95/14398

PCT Pub. Date: Jun. 1, 1995

[30] Foreign Application Priority Data

| | | | |
|---|---|---|---|
| Nov. 29, 1993 | [GB] | United Kingdom | 9324464 |
| May 19, 1994 | [GB] | United Kingdom | 9410028 |
| Sep. 15, 1994 | [GB] | United Kingdom | 9418544 |

[51] Int. Cl.[6] ..... A24D 1/04; A24D 3/00

[52] U.S. Cl. ..... 131/331; 131/332

[58] Field of Search ..... 131/331, 332, 131/345; 55/522

[56] References Cited

U.S. PATENT DOCUMENTS

| | | | |
|---|---|---|---|
| 4,246,221 | 1/1981 | McCorsley, III . | |
| 4,416,698 | 11/1983 | McCorsley, III . | |
| 5,022,964 | 6/1991 | Crane et al. | 131/345 X |
| 5,509,430 | 4/1996 | Berger | 131/345 X |

OTHER PUBLICATIONS

Dr. R.J.K. Shepherd, "'Green' Filters," Tobacco Reporter, vol. 120, Aug. 1993, pp. 46–48.

*Primary Examiner*—Jennifer Bahr
*Attorney, Agent, or Firm*—Fish & Richardson P.C.

[57] ABSTRACT

A cigarette filter in which the body of the filter comprises paper containing, or consisting essentially of, lyocell fibres. The invention also relates to a cigarette incorporsting such a filter.

9 Claims, No Drawings

CIGARETTE FILTERS

The present invention relates to paper filters for cigarettes.

Fibre-containing filters for cigarettes are well known. In one known form of construction, the filter body consists of a tow of continuous filaments, commonly cellulose acetate (acetate) filaments, arranged parallel to the long axis of the cigarette. In another known form of construction, the filter body consists of pleated or fluted paper compressed into a cylinder. The paper is subjected to a grooving process to allow it to be so pleated or fluted. Such forms of construction contain a single filter element and may be called "mono" filters. Another known form of construction is the so-called "dual" filter which contains two filter elements, for example a paper filter towards the interior and a tow filter towards the exterior of the cigarette. A further known form of construction is the so-called "triple" filter, which contains three filter elements, for example a paper filter and a tow filter as in the "dual" construction separated by an air gap or by an activated carbon filter.

Paper filters are known to be generally more efficient at removing tar from tobacco smoke than are tow filters. High tar removal efficiency is particularly desirable in view of the trend towards low-tar cigarettes. It is an object of the present invention to provide a cigarette filter tip with high tar removal efficiency. It is a further object of the invention to provide various constructions of cigarette with low tar delivery.

According to the present invention there is provided a cigarette filter characterised in that the body of the filter comprises paper which contains or consists essentially of lyocell fibres. The invention further provides a cigarette which incorporates such a filter.

Lyocell fibres are known materials, and their manufacture is described for example in U.S. Pat. No. 4,246,221. They are available commercially from Courtaulds plc under the Trade Mark "Tencel". They are made by dissolving cellulose in a solvent and extruding the solution so formed through a spinnerette into a coagulating bath which serves to precipitate the cellulose and wash the solvent from the fibre. This process may be called solvent-spinning, and lyocell fibres may also be called solvent-spun cellulose fibres. The cellulose is usually woodpulp. The solvent may be a tertiary amine N-oxide, preferably an aqueous tertiary amine N-oxide, in particular N-methylmorpholine N-oxide. If the solvent is a tertiary amine N-oxide, the coagulating bath is preferably an aqueous bath. The solvent-spinning process is to be distinguished from other known processes for the manufacture of cellulose fibres which rely on the formation and decomposition of a chemical derivative of cellulose, for example the viscose process. Lyocell fibres are readily biodegradable. The lyocell fibre may contain a matt pigment such as titanium dioxide, and may be bleached.

The cigarette filter of the invention has a high filtration efficiency in comparison with known paper filters.

Paper for use in the cigarette filter of the invention may be manufactured using conventional papermaking technology and equipment. The basis weight of the paper used in the filter of the invention may in general be similar to that of the conventional paper used in known paper filters, and may generally be in the range 15 to 150, preferably 20 to 80, grams per square meter. The paper may consist essentially of lyocell fibres, or may contain other types of fibre, for example plant fibres such as woodpulp and/or acetate fibres, in addition to the lyocell fibres. It has surprisingly been found that the paper may include up to about 50 percent by weight woodpulp without significant reduction in tar removal efficiency, although naturally at higher proportions than this the efficiency increasingly tends towards that of conventional woodpulp paper. Paper which comprises at least 25 percent by weight lyocell fibres, particularly in blend with woodpulp fibres, may be preferred. Paper which contains about 50 percent by weight of lyocell fibres and of woodpulp fibres may be further preferred. It has also been found that inclusion of a proportion of woodpulp in the blend may assist in the paper formation process, leading to improved paper quality.

The cross-direction (CD) tensile strength of the paper used in the filter of the invention should be chosen to allow the correct degree of grooving and so permit the paper to be pleated or fluted. A low CD tensile strength may mean that too much grooving is produced with the consequence that the pressure drop through the filter is too high, whereas a high CD tensile strength may mean that too little grooving is produced with the consequence that the end appearance of the filter is visually unsatisfactory.

The lyocell fibre in the filter of the invention is preferably fibrillated. Lyocell fibres may be fibrillated by subjecting them to mechanical abrasion in the wet state, as for example during a papermaking process. Fibrillation results in the partial detachment of thin fibres ("fibrils") from the body of the fibre, so that the individual fibres acquire a "hairy" appearance. Fibrillated lyocell fibres have an increased surface area compared with unfibrillated fibres, and it is thought that this is advantageous in providing efficient filtration.

The paper may consist of a blend of highly fibrillated lyocell fibres with other types of fibre, for example plant fibres such as woodpulp and/or acetate fibres. Highly fibrillated lyocell fibres may be produced by severe refining conditions. Papermaking stock containing such fibres is very slow draining and is therefore generally unsatisfactory for use of the commercial manufacture of paper for cigarette filters. Such stock may be blended with stock containing other types of fibre, including stock containing lowly fibrillated lyocell fibres, and used in papermaking. The blend of highly fibrillated lyocell fibre stock and of stock containing other types of fibre may be chosen to give the appropriate balance of papermaking, paper and filter properties and cost. A blend of highly fibrillated lyocell fibres and acetate fibres may be found to provide good drainage in papermaking, good paper strength, better filtration efficiency than acetate alone, flushable (i.e. water-dispersible) cigarette filters and more rapid biodegradability than filters made from acetate fibres alone.

The filter of the invention may be a mono, dual or triple filter. Dual and triple filters comprising an acetate tow filter towards the exterior of the cigarette and a lyocell paper filter towards the interior of the cigarette may be preferred. Such filters exhibit good resistance to external staining.

Filter elements and filters according to the invention can be used in ventilated and unventilated filter cigarettes with a wide range of tobacco rods. By way of example only, such a tobacco rod may have one or more or all of the following properties:

Yield Nicotine/Tar×10=0.05–1.0

Tobacco Rod density=100–260 kg/m$^3$

Draw Resistance (measured enclosed)=35–70 mm. WG.

Air permeability of cigarette paper=10–150 Coresta Units

Also purely by way of example, a filter cigarette according to the invention, whether employing a tobacco rod as exemplified above or one of different properties, may exhibit one or more or all of the following properties:

Yield Nicotine / Tar×10=0.05–1.5

Tar yield=<1–10 mg.

Draw Resistance (measured unenclosed)=30–150 mm. WG.

Filter Ventilation=0–80%

Puff Count≧5

The above parameters are measured by the standard procedures and in the standard units. WG stands for water gauge.

In addition, the tobacco blend may contain significant proportions of expanded tobacco and stem.

The filters of the invention, for example containing lyocell fibres alone or in blend with woodpulp, give greatly improved tar retention properties at a wide range of pressure drops compared with prior art cellulose acetate and paper (100% woodpulp) filters. The filters of the invention are useful in the manufacture of cigarettes with tar delivery 6 mg or less, possibly as low as 1 mg or less. These low tar deliveries can be achieved with significantly lower ventilation than is necessary with prior art filters. High levels of ventilation are generally undesirable for consumer acceptability. Furthermore, these low tar deliveries can be obtained at acceptable draw resistance, further adding to the improvement in consumer acceptability over prior art cigarettes. Filters have been made according to the invention which have better filtration efficiency at low pressure drop than prior art filters with the same degree of ventilation.

Examples of cigarettes manufactured according to the invention include cigarettes having the following construction: tobacco rod tar delivery (yield) 25 mg, pressure drop 50 mm; cigarette paper permeability 60 Coresta; required tar delivery (yield) 4 mg. The retention and ventilation which provide these tar yields can be calculated from the equation.

Final Tar Yield=Tobacco Rod Yield×(100-R)/100×(100-V)/100 where R=Filter Retention % and V=Ventilation %. If ventilation is 0%, then the calculated required filter retention is 84%. Such a high retention is not believed to be achievable in an acceptable conventional filter cigarette. Cigarettes containing a 20 mm filter according to the invention have been made which exhibit such a retention value at an acceptable cigarette pressure drop (ca. 144 mm. WG).

One type of prior art cigarette may incorporate a mono paper filter which has tar retention 66% and pressure drop 88 mm.WG. In order to achieve the required 4 mg tar delivery, ventilation is 53%, giving cigarette pressure drop around 95 mm.

Another type of prior art cigarette may incorporate a mono acetate filter (1.5 denier tow) which has tar retention 55% and pressure drop 89 mm.WG. In order to achieve the required 4 mg tar delivery, ventilation is 64%, giving an undesirably low cigarette pressure drop around 87 mm.

A cigarette according to the invention may incorporate a lyocell paper filter which has tar retention 77% and pressure drop 84 mm.WG. In order to achieve the required 4 mg tar delivery, ventilation is a desirably-low 30%, giving a cigarette pressure drop around 110 mm.

Cigarettes with even lower levels of tar delivery may readily be made. Other cigarette constructions to those herein exemplified will readily suggest themselves to the cigarette designer. It is an advantage of the invention that cigarettes with low tar delivery can be made with low levels of ventilation. This can provide a reduced amount of sidestream smoke.

Alternatively, a filter can be constructed according to the invention which is of lighter weight than that of known types of filter which have the same filtration efficiency. This allows the construction of lighter cigarettes. Furthermore, the draw resistance of such filters according to the invention may be less than that of such prior art filters.

It has been found that the filters of the invention absorb moisture from the smoke as the cigarette is smoked. As a consequence, the filter swells and the pressure drop across the filter increases. It is thought that this may confer some progressive filtration properties as the cigarette is smoked. Furthermore, it is thought that this swelling may provide the particular advantage that cigarettes can be made which exhibit a relatively constant pressure drop from puff to puff.

The invention is illustrated by the following Example:

EXAMPLE

Samples of paper were made using 1.7 decitex 6 mm matt lyocell fibre available from Courtaulds plc under the Trade Mark "Tencel".

Fibre dispersion was carried out in a pulper, at a stock consistency of around 1.5%. The stock was then discharged into a chest where the stock was gently circulated by a paddle and was diluted to a desired consistency. From the chest, the stock was cycled at ambient temperature through a conical refiner at a flow rate of 350–400 liters/min. The refiner had a bar spacing of 15 mm to fibrillate rather than cut the fibre. The progress of refining was checked by measuring the stock freeness (Schopper-Riegler) at intervals. Following refining, the stock was further diluted by addition of typically about half its volume of water and pumped to a machine chest. The fibre was pumped from the machine chest to a dilution box, then through a flow disperser which ensured an even dispersion of fibre across the headbox (which forms the paper onto a wire). Two sets of suction boxes removed water, the paper was then run through two presses (one on each side), a drum dryer and a calender and collected on a roll. Table 1 contains information about papermaking conditions:

TABLE 1

| Reference code | A | B |
|---|---|---|
| Refining consistency % | 0.44 | 0.44 |
| Refined stock freeness °SR | 36 | 48 |

The samples had the properties shown in Table 2:

TABLE 2

| Reference code | A | B |
|---|---|---|
| Basis weight g/m$^2$ | 28.9 | 28.4 |
| Moisture % | 6.8 | 6.5 |
| Porosity Coresta | 458 | 215 |
| Tensile strength kg - MD | 1.42 | 1.174 |
| | 1.45 | 1.517 |
| Tensile strength kg - CD | 0.595 | 0.673 |
| | 0.651 | 0.810 |
| Stretch % - MD | 1.5 | 1.5 |
| | 1.6 | 1.7 |
| Stretch % - CD | 1.7 | 1.9 |
| | 1.9 | 2.0 |
| Bulk micron | 66.0 | 63.5 |
| Burst psi | 7.11 | 7.11 |
| Climb mm | 55 | 64 |

MD stands for machine direction. Climb is a measurement of water capillary rise.

Filter rods were made from sample A slit to 300 mm width and wrapped with 27 g/m$^2$ paper (made from woodpulp). Nominal rod dimensions were 108 mm length×24.6 mm circumference. Rods were cut to 20 mm length tips for testing. The results shown in Table 3 were obtained:

TABLE 3

| | |
|---|---|
| Circumference mm | 25.09 |
| S.D. | 0.16 |
| Rod pressure drop mm WG | 538 |
| C.V. % | 9.1 |
| Rod weight g | 1.087 |
| C.V. % | 1.9 |
| Filter density g/cm$^3$ | 0.186 |
| Hardness % | 94.12 |
| Tip pressure drop mm WG | 118 |
| C.V. % | 13.1 |
| Tip tar retention % | 82.3 |
| Tip nicotine retention % | 87.1 |

Hardness is a measurement of shape retention under application of a lateral force, higher values indicating greater resistance to compression.

A conventional paper filter of this size and pressure drop would be expected to have a tar retention of about 74%.

The samples of paper were slit to 250 mm width and rods produced at the maximum embossing level, wrapped with 27 g/m$^2$ paper. Nominal rod dimensions were 108×24.6 mm. Rods were cut to 20 mm length tips for testing. The results shown in Table 4 were obtained:

TABLE 4

| Reference code | A | B |
|---|---|---|
| Circumference mm | 25.05 | 24.37 |
| S.D. | 0.17 | 0.11 |
| Rod pressure drop mm WG | 346 | 461 |
| C.V. % | 10.5 | 6.3 |
| Rod weight g | 0.928 | 0.979 |
| C.V. % | 3.0 | 1.4 |
| Filter density g/cm$^3$ | 0.157 | 0.176 |
| Hardness % | 93.04 | 94.46 |

TABLE 4-continued

| Reference code | A | B |
|---|---|---|
| Tip pressure drop mm WG | 72 | 93 |
| C.V. % | 13.6 | 7.0 |
| Tip tar retention % | 77.9 | 74.6 |
| Tip nicotine retention % | 78.5 | 75.5 |

These filters exhibited considerably higher tar retention values than either cellulose acetate tow filters or conventional semi-crepe tissue paper filters.

I claim:

1. A cigarette filter, wherein the body of the filter comprises paper which contains lyocell fibres.

2. A cigarette filter according to claim 1, wherein the basis weight of the paper is in the range 15 to 150 grams per square meter.

3. A cigarette filter according to claim 2, wherein the basis weight of the paper is in the range 20 to 80 grams per square meter.

4. A cigarette filter according to claim 1, wherein the paper consists essentially of lyocell fibres.

5. A cigarette filter according to claim 1, wherein the paper consists of a blend of lyocell fibres with at least one of plant fibres and cellulose acetate fibres.

6. A cigarette filter according to claim 5, wherein the paper consists of a blend of lyocell fibres and woodpulp and contains up to about 50 percent by weight of woodpulp.

7. A cigarette filter according to claim 1, wherein the lyocell fibres are fibrillated.

8. A cigarette incorporating a filter according to claim 1.

9. A cigarette filter wherein the body of the filter comprises paper which contains lyocell fibres and further wherein the lyocell fibres are made by a process including the step of extruding a solution of cellulose in a tertiary amine N-oxide into an aqueous coagulating bath.

* * * * *